US007430975B2

(12) United States Patent
Kronenberger

(10) Patent No.: US 7,430,975 B2
(45) Date of Patent: Oct. 7, 2008

(54) METHOD OF PROVIDING AN ADORNED ARTICLE AND AN ADORNED ARTICLE MADE USING THE METHOD

(75) Inventor: Ronald Kronenberger, Riverwoods, IL (US)

(73) Assignee: American Needle, Buffalo Grove, IL (US)

( * ) Notice: Subject to any disclaimer, the term of this patent is extended or adjusted under 35 U.S.C. 154(b) by 477 days.

(21) Appl. No.: 11/043,002

(22) Filed: Jan. 25, 2005

(65) Prior Publication Data

US 2005/0193768 A1 Sep. 8, 2005

Related U.S. Application Data

(63) Continuation-in-part of application No. 10/726,877, filed on Dec. 3, 2003, now Pat. No. 7,237,498.

(51) Int. Cl.
*D05B 3/00* (2006.01)
*D05B 93/00* (2006.01)

(52) U.S. Cl. ..... 112/475.09; 112/475.17; 112/439

(58) Field of Classification Search ..... 112/475.11, 112/475.24, 475.14, 475.09, 439, 104; 2/69, 2/209.13, 244, 171.1, 175.1, 172; 428/77; 40/329, 1.5; 156/93; 206/575
See application file for complete search history.

(56) References Cited

U.S. PATENT DOCUMENTS 363,294 A * 5/1887 Burmeister ..... 451/80
4,555,435 A * 11/1985 Walter ..... 428/79
4,820,164 A * 4/1989 Kemper ..... 434/238
4,930,234 A * 6/1990 Schmidt ..... 40/1.5
5,129,522 A * 7/1992 Druskoczi ..... 206/574
5,803,266 A * 9/1998 Blackwelder ..... 206/575
5,943,702 A * 8/1999 Kronenberger ..... 2/171.1
6,021,525 A * 2/2000 Mertins ..... 2/172
6,272,689 B1 * 8/2001 Kronenberger ..... 2/175.1
6,519,779 B1 * 2/2003 Taguchi ..... 2/209.12
6,675,512 B1 * 1/2004 Shwartz et al. ..... 40/329
6,718,895 B1 * 4/2004 Fortuna ..... 112/475.19
6,883,449 B2 * 4/2005 Burrell et al. ..... 112/475.19
7,243,377 B2 * 7/2007 Ashy ..... 2/209.13

OTHER PUBLICATIONS

Jacquin Sanders, "Mom's Blankets Cover Life in Army Series:Faces in the crowd", Nov. 26, 1992, St. Petersburg Times.*

* cited by examiner

*Primary Examiner*—Ismael Izaguirre
(74) *Attorney, Agent, or Firm*—Wood, Phillips, Katz, Clark & Mortimer

(57) ABSTRACT

A method including the steps of: providing an article having an exposed surface defined by at least one substrate layer; providing at least a first adornment on the substrate layer, so that the article has a first appearance and to meet an actual or anticipated demand for the article with the first appearance; identifying an actual or anticipated demand for the article having an appearance different than the first appearance; removing the at least first adornment; and providing at least a second adornment on the substrate layer so that the article has a second appearance different than the first appearance and to meet an actual or anticipated demand for the article with the second appearance; and making the article with the second appearance available to meet an actual or anticipated demand for the article with the second appearance. An article with adornment is also provided.

21 Claims, 8 Drawing Sheets

METHOD OF PROVIDING AN ADORNED ARTICLE AND AN ADORNED ARTICLE MADE USING THE METHOD

CROSS REFERENCE

This is a continuation-in-part application of Ser. No. 10/726,877, filed Dec. 3, 2003 now U.S. Pat. No. 7,237,498.

BACKGROUND OF THE INVENTION

1. Field of the Invention

This invention relates to portable articles and, more particularly, to a method of fixedly placing an adornment on an article, which adornment may subsequently be removed to change the appearance of the article. The invention is also directed to an adorned article.

2. Background Art

Many articles, in many different fields, are enhanced by attaching adornment thereto. It is common to use a basic article configuration and to selectively attach different adornment thereon to change the appearance thereof. This concept is particularly prevalent in the apparel industry.

One example of apparel, to which a wide range of adornment is attached, is headwear, such as baseball-style caps. The conventional baseball-style cap has a crown with a projecting brim/bill. Adornment, such as in the form of a team name or logo, is commonly attached to the front wall of the crown. This adornment may have many different forms. The adornment may be embroidered directly on a layer or layers defining the crown front wall. Alternatively, the adornment may be formed by a silk screening process or through the use of an impressionable label. Most commonly, the adornment is in the form of a discrete patch with the desired information thereon that may take virtually any form, i.e. words, logos, ornamentation, depictions of animate or inanimate objects, etc.

These patches are capable of being fixedly attached to the crown of the headwear piece in a number of different manners. In one form, an adhesive layer is provided on the back of the patch. By elevating the temperature of the adhesive layer, with the patch urged against the crown surface under pressure, the patch can be permanently bonded to the crown surface.

In another form, the patch is maintained in place by stitching. Typically, the stitching will extend continuously around the perimeter of the patch. In a lockstitch sewing operation, the stitching can be formed so that severance of the thread at any one location does not release adjacent stitches.

This type of adorned headwear is commonly offered as a souvenir at competitions, such as sporting events. One common practice in this industry has been to customize headwear by recognizing the victorious individual or team in a competition with an appropriate designation on the headwear. Fans and observers of such events have become accustomed to having such customized headwear available, either immediately after the conclusion of the event, or soon thereafter. Purveyors of headwear try to make such customized headwear available while the event is fresh in people's minds and there is enthusiasm that may lead to the purchase of one or more souvenir pieces of headwear, and other related paraphernalia.

At times, the volume demand for such headwear is extremely high. In large cities, hundreds of thousands of potentially rabid fans, caught up in the frenzy of a local championship, may be anxious to purchase a commemorative souvenir. To capitalize on the partisan energy that exists within a relatively short frame after such an event, purveyors of such souvenirs generally seek to have high volumes of the customized headwear available at the earliest possible moment after a victor is determined. Early exposure may translate into substantially greater sales than those of competitors.

This rush to market has lead to a number of different manufacturing and marketing practices. One practice is to produce large volumes of headwear identifying each of the participants as the victor. From a marketing standpoint, this is the most effective approach in that the customized headwear can be made available to fans exiting a stadium or arena immediately after the event which crowns the victor.

The obvious drawback with this marketing technique is that the headwear recognizing the losing participant as victor is unuseable. The owner of this stock is left with the options of either disposing of the same, or trying to alter it so that the basic headwear piece and/or the attached adornments can be re-used.

Generally, it is not practical to remove patches that have been attached using a heat activated adhesive. The patch and/or the headwear piece may be destroyed in an attempt to effect removal.

Patches that are applied using a continuous lock stitch sewing method are likewise relatively permanently attached. If removal is desired, each of potentially numerous stitches must be individually severed as by a tool with a sharpened cutting edge. This may be sufficiently time consuming that it is not cost effective to salvage either the headwear piece or the adornment.

As a result, historically purveyors of headwear have routinely disposed of headwear with adornment that is inaccurate or inappropriate. Losses can be very significant, so as to seriously adversely affect profits in a particular market.

This problem has lead some to produce lower end headwear with adornment that is defined by other than separately applied patches. However, those in the industry with reputations for high quality headwear do not generally wish to participate in this alternative manufacturing process. Additionally, those seeking a souvenir commemorating a rare event may wish to purchase a high quality headwear piece that will serve as a lifelong remembrance of the particular event.

The industry continues to seek out ways to provide high quality, commemorative headwear on an expedited basis without the inconvenience and potentially severe economic consequences, discussed above.

SUMMARY OF THE INVENTION

In one form, the invention is directed to a method of providing an article to meet an actual or anticipated demand for the article. The method includes the steps of: providing an article having an exposed surface defined by at least one substrate layer; providing at least a first adornment on the substrate layer, so that the article has a first appearance and to meet an actual or anticipated demand for the article with the first appearance; identifying an actual or anticipated demand for the article having an appearance different than the first appearance; removing the at least first adornment; providing at least a second adornment on the substrate layer so that the article has a second appearance different than the first appearance and to meet an actual or anticipated demand for the article with the second appearance; and making the article with the second appearance available to meet an actual or anticipated demand for the article with the second appearance.

In one form, the step of providing an article involves providing an article of clothing.

The step of providing an article may involve providing a headwear piece.

The step of providing at least a first adornment on the substrate layer may involve the steps of providing a first patch and securing the first patch fixedly to the substrate layer.

The step of securing the first patch may involve securing the first patch through sewn thread or an adhesive.

The step of providing the first patch may involve preliminarily securing the first patch fixedly to the substrate layer. The method may further include the steps of committing to provide an article with the first appearance and thereafter performing a supplemental securing step to more permanently secure the first patch fixedly to the substrate layer.

The step of providing at least a first adornment on the substrate layer may involve providing the at least first adornment on the substrate layer at a first location. The step of providing at least a second adornment may involve providing the at least second adornment at the first location.

Alternatively, the at least second adornment may be provided at a second location that is at least partially spaced from the first location.

The step of removing the at least first adornment may involve heating the adhesive.

In one form, the step of providing at least a first adornment involves providing at least a first adornment with an identification of a first sports team. The step of providing at least a second adornment may involve providing the at least second adornment with an identification of a second sports team that competes with the first sports team.

The step of providing at least first and second adornments may involve providing the at least first and second adornments that at least one of a) are different in shape, b) have different information thereon, and c) are different in appearance.

The method may further include the step of displaying an article with the second appearance for sale at a first site. The step of providing at least a second adornment may involve providing the at least second adornment at the first site.

The step of providing at least a first adornment may involve providing the at least first adornment with an identification relating to a first participant in a competition involving the first participant and a second participant. The step of providing at least a second adornment may involve providing the at least second adornment with an identification relating to the second participant.

The at least first adornment may overlie a first area on the exposed surface of the substrate layer. The step of providing the at least second adornment may involve providing the at least second adornment so as to fully cover the first area.

The invention is further directed to the combination of an article having an exposed surface defined by a substrate layer, a first adornment that was initially fixedly attached to the substrate layer to define an article having a first appearance and thereafter removed from the article, and a second adornment fixedly attached to the substrate layer so that the article has a second appearance.

In one form, the first adornment was fixedly attached to the substrate layer to cover a first area and the second adornment fully covers the first area.

The article may be a headwear piece with a crown and a brim/bill projecting from the crown.

In one form, the article has a residual alteration from at least one of sewn thread and an adhesive used to secure the first adornment to the substrate layer.

In one form, the first adornment has an identification of a first participant in a competition involving the first participant and a second participant. The second adornment has an identification of the second participant.

The second adornment may be in the form of a patch.

DETAILED DESCRIPTION OF THE DRAWINGS

Figure 1:
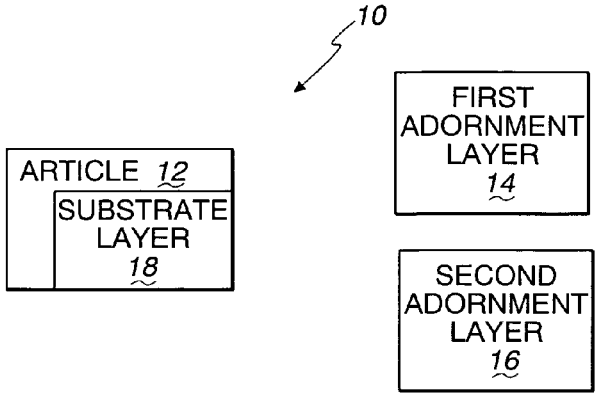
FIG. 1 is a schematic representation of a kit, according to the present invention, including an article and first and second adornment layers which are selectively interchangeably attachable to the article.

Referring initially to FIG. 1, one form of the invention is shown at 10 in a form of a kit, with an article 12 and first and second separate adornment layers 14, 16, respectively. The article 12 can be virtually any type of consumer article, preferably that is portable in nature. For purposes of illustration, the article 12 will be described as any article having at least one substrate layer 18 which can be sewn therethrough using conventional stitching equipment and techniques. Particularly suitable for practice of the present invention are apparel items, such as headwear, shirts, pants, socks, dresses, coats, purses, etc.

According to the invention, the first and second adornment layers 14, 16 can be provided in kit form in conjunction with the article 12 to be interchangeably attached thereto to selectively create two different appearances for the article 12. The first and second adornment layers 14, 16 may be different or the same. In the latter case, worn or faded information on the first adornment layer 14 can be replaced with like ornamentation on the second adornment layer 16 to provide an improved appearance.

Figure 2:
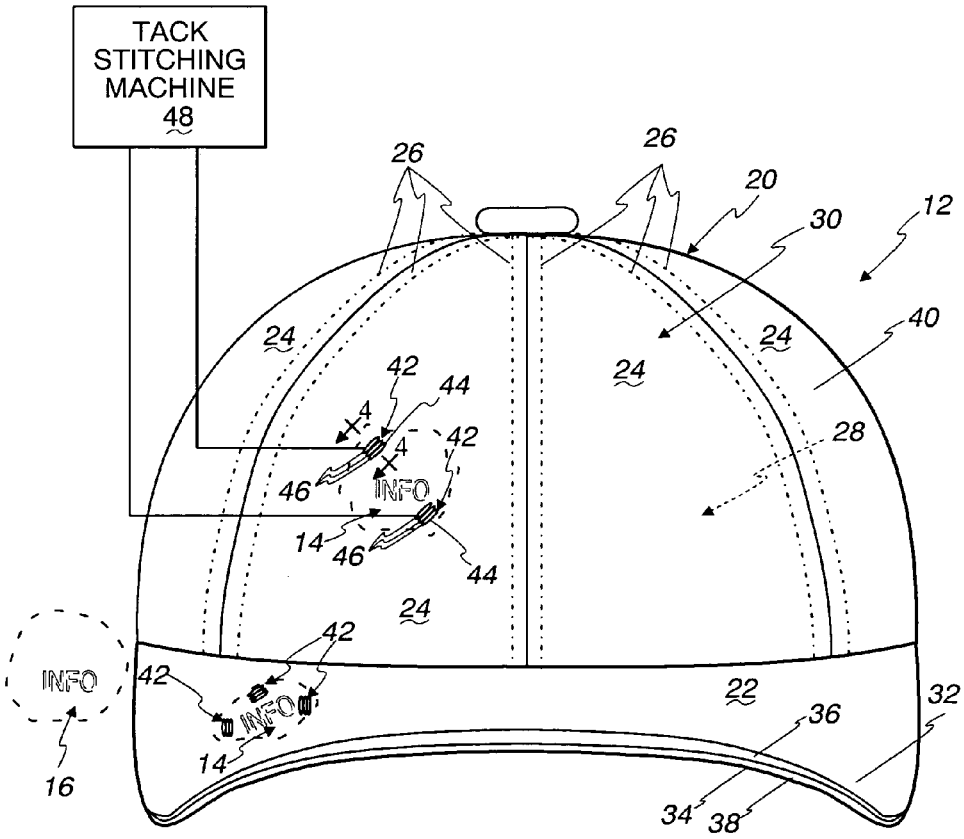
FIG. 2 is a front elevation view of the article in FIG. 1, in the form of a headwear piece, with the first adornment layer attached thereto and showing the second adornment layer separated from the headwear piece.
Figure 3:
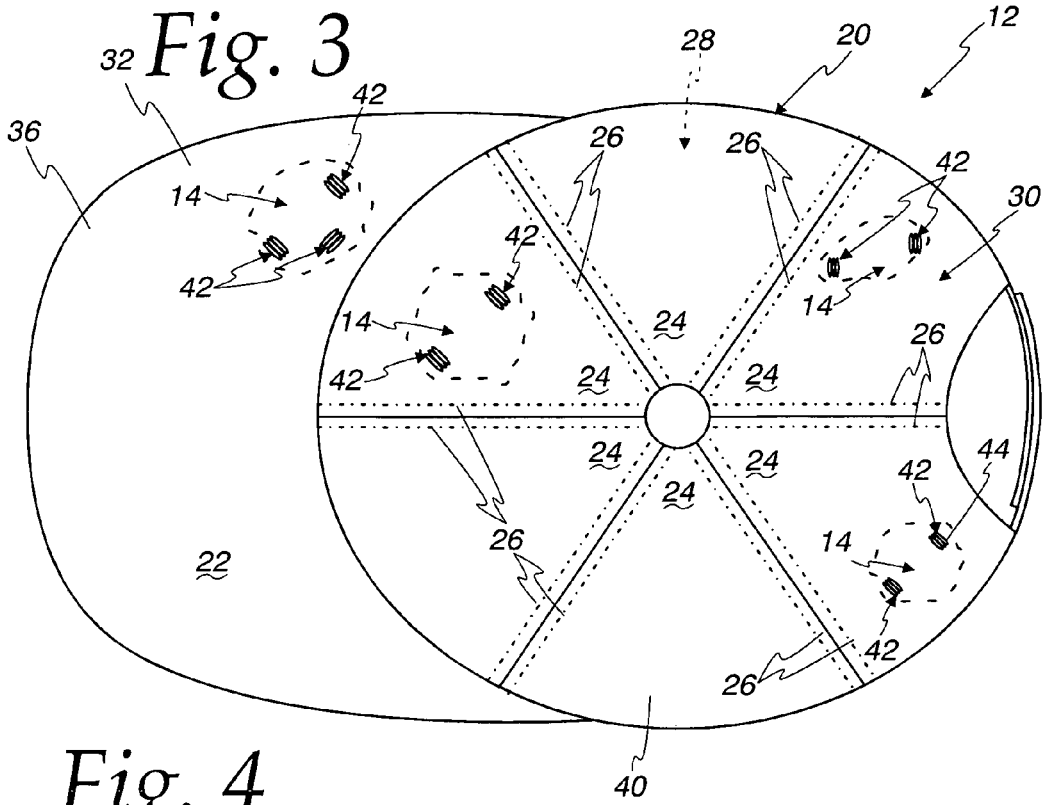
FIG. 3 is a plan view of the headwear piece in FIG. 2.

In FIGS. 2 and 3, the article 12 is shown in the form of a headwear piece. The headwear piece 12 is in the form of a baseball-style cap including a crown 20 with a brim/bill 22 projecting forwardly from the crown 20. The crown 20 is defined by a plurality of triangular, fabric gores 24, sewn edge-to-edge through lines of stitching 26 to produce a continuous cup-shaped receptacle 28 for the head of a wearer. The crown 20 has an exposed external surface 30 defined by the gores 24. The crown 20 may actually be defined by an additional layer or layers sewn on the underside thereof, partially or fully over the inside surface, as to define a backing structure, a sweatband, etc.

The brim/bill 22 has an exposed upwardly facing surface 32 and a downwardly facing surface 34, which surfaces may be defined by the same or separate layers 36, 38, shown. For purposes of illustration, the crown 20 will be described as being made from a single layer 40.

It should be understood that while fabric is preferred for constructing the layers 36, 38, 40, virtually any material that can be sewn through, using known manual or automated techniques, is contemplated by the invention.

Figure 4:
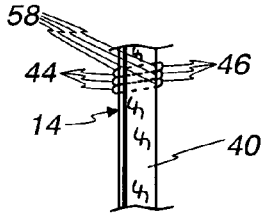
FIG. 4 is an enlarged, fragmentary, cross-sectional view of a portion of the headwear piece in FIGS. 2 and 3, taken along line 4-4 of FIG. 2, and showing tack stitching utilized to maintain the first adornment layer on the headwear piece.

The layer 40 defines a substrate for the application of the first adornment layer 14. The first adornment layer 14 has "information" thereon which may take virtually any shape and have any color or combination of colors. The information may be in the form of a decoration, an identification of a team or individual participating in a competition, a logo, the depiction of an object or scene, etc. The first adornment layer 14 is fixedly attached to the crown layer 40 by tack stitches 42, in this case at two discrete locations on the first adornment layer 14, as seen also in FIG. 4. Tack stitching is a conventional process whereby thread 44 is directed through superposed layers to provide one or more adjacent stitches 46 which cinch the connection of the layers. Tack stitches, which can be performed by a conventional tack stitching machine 48, are commonly locally grouped in numbers, depending upon the required tenacity of the connection, and can be simply formed substantially instantaneously by the tack stitching machine 48 in a single step process. In this embodiment, three tack stitches 46 are shown at each tack stitch location.

It is contemplated that the first adornment layer 14 could be attached anywhere on the crown 20. Two alternative, exemplary locations on the crown 20 for the first adornment layer 14 are shown in FIG. 3. At each location, the tack stitching 42 is utilized. The tack stitching 42 is preferably provided at least two discrete spaced locations to positively secure the first adornment layer 14 to the substrate layer 40. The shape and size of the first adornment layer 14 are not critical to the present invention and may vary significantly. The number of tack stitching locations and the number of tack stitches 46 used at each location will be dictated by the shape and size of the first adornment layer 14 and the desired strength of connection of the adornment layer 14. It is desirable that the number of tack stitches 46 utilized, the number of locations at which the tack stitches 46 are formed, and the precise placement of the tack stitches 46 be coordinated so that the first adornment layer 14 is positively secured to the headwear piece 12 and gives a neat, finished appearance. As shown in FIGS. 2 and 3, the first adornment layer 14 can be similarly attached to the substrate layers 36, 38 on the brim/bill 22 utilizing this same technique.

Figure 6:
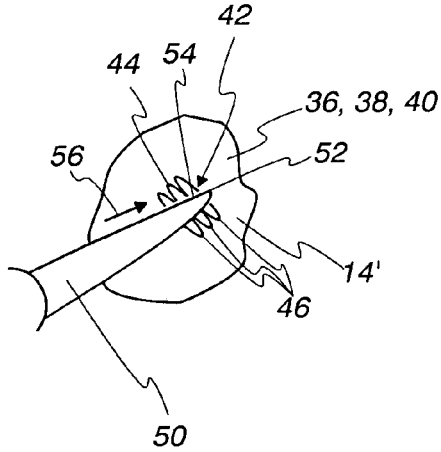
FIG. 6 is an enlarged view as in FIG. 5 showing the cutting blade after it has fully severed thread in the tack stitches at a tack stitching location.
Figure 5:
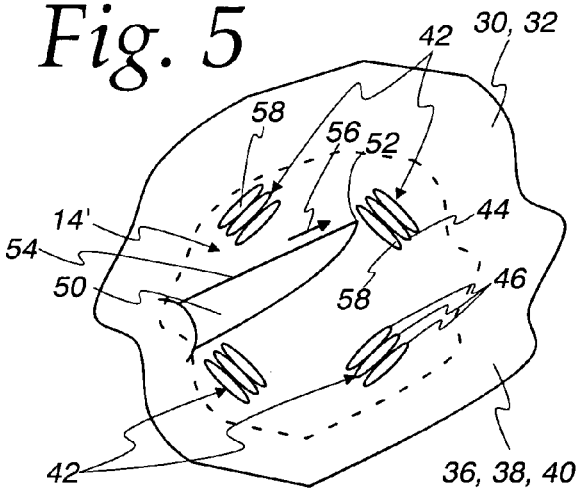
FIG. 5 is a fragmentary, elevation view of another form of adornment layer tack stitched through part of the headwear piece in FIGS. 2 and 3 and showing a cutting blade in a position preparatory to severing thread on one of the tack stitches.

By utilizing tack stitching, the first adornment layer 14 lends itself to being removed essentially without damaging either the first adornment layer 14 or the substrate layers 36, 38, 40. The removal procedure is depicted in FIGS. 5 and 6, each of which shows a modified form of first adornment layer 14' attached to one of the substrate layers 36, 38, 40 using the tack stitching 42. A cutting blade 50 with a pointed tip 52 and a sharpened edge 54 is moved in the direction of the arrow 56 to cause the tip 52 to move through loops 58 (see also FIG. 4) formed against the surface 30, 32 in the tack stitching process. The loops 58 can be similarly cut on either the inside or outside of the layer 40, or at the top or bottom of the brim/bill 22. By directing the cutting blade 50 in the direction of the arrow 56, the blade 52 wedges into the loops 58 and, one by one, severs the loops 58 to allow the thread 44 to be separated from the first adornment layer 14' and the substrate layers 36, 38, 40. This process can be repeated at each location at which there is tack stitching. At the completion of this process, the first adornment layer 14' can be cleanly separated from the substrate layers 36, 38, 40 without damaging the substrate layers 35, 38, 40. This permits the application of the second adornment layer 16, shown in FIG. 2, which can be applied at the location from which the first adornment layer 14 is removed, or elsewhere on either the crown 20 or brim/bill 22.

If information on the first and second adornment layers 14, 16 is the same, the appearance of the headwear piece 12 can be changed by placing the second adornment layer 16 at a location that is different than that from which the first adornment layer 14 was removed. If the first and second adornment layers 14, 16 are different in appearance, by reason of either their shape, color, the nature of the information, etc., a different appearance is realized by substituting the second adornment layer 16 for the first adornment layer 14 at either the same location from which the first adornment 14 was removed, or at a second location. Even if the first and second adornment layers 14, 16 have the same appearance, placing the second adornment layer 16 at the same location from which the first adornment layer 14 was removed may still produce a different appearance in the event that, for example, the first adornment layer 14 has a faded or worn appearance, or is otherwise damaged or stained.

Figure 7:
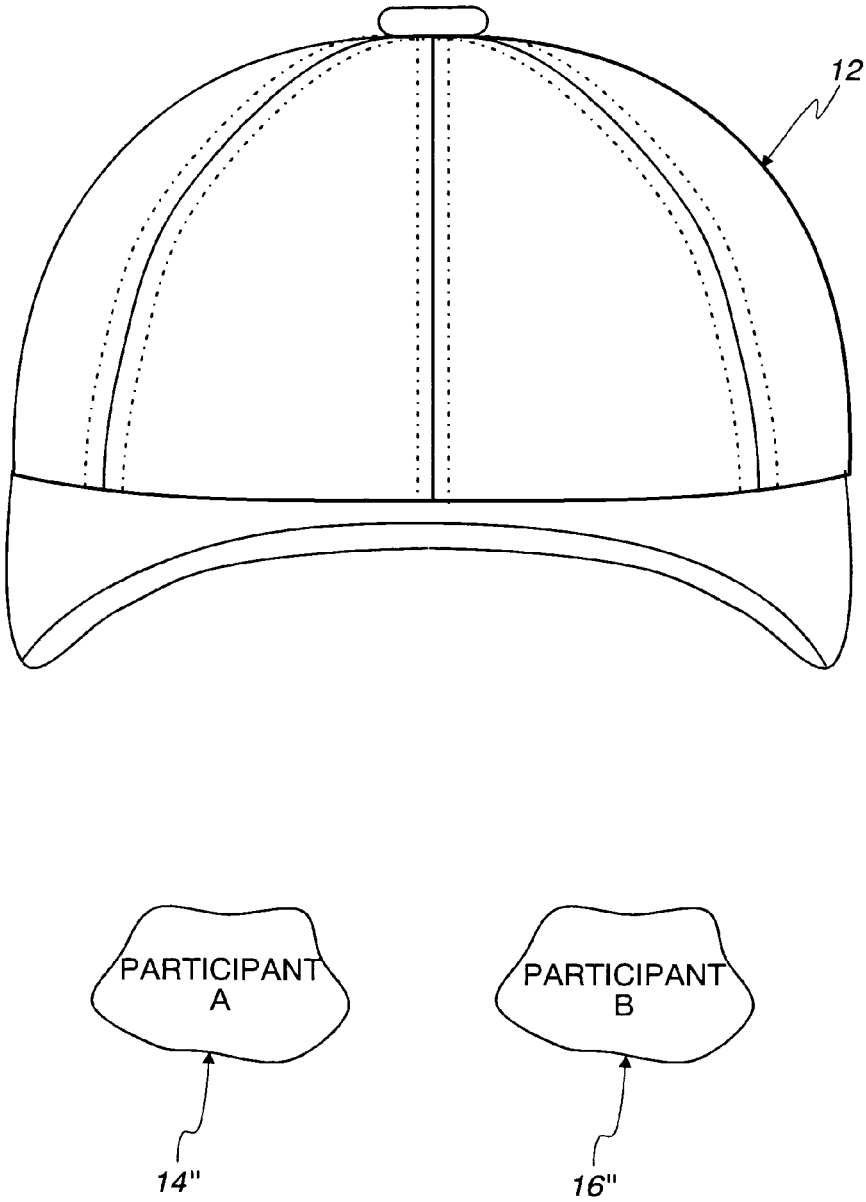
FIG. 7 is a view as in FIG. 2 and showing first and second adornment layers interchangeably mountable on a headwear piece and shown separated from the headwear piece and with two separate participants in an event.

One particularly useful application for the inventive concept is demonstrated using the headwear piece 12, and first and second adornment layers 14", 16", as shown in FIG. 7. In this particular embodiment, the headwear piece 12 has the same configuration as shown in FIGS. 1 and 2. The first adornment layer 14", which may be any size, shape or color, has some information that identifies or relates to one of two participants, in this case participant A in a competitive event, such as a sports event, involving additionally participant B. The second adornment layer 16" likewise has any shape, size or color and has information related to participant B. The information related to the participants may be the actual naming of the participants, a logo associated with the participants, such as a team logo, etc. The components 12, 14", 16" can be sold as a kit which permits a unique manufacturing/marketing method, as depicted in flow diagram form in FIG. 8.

In the initial step, the first and second adornment layers 14", 16" and an article, in this case a headwear piece 12, are provided as shown at block 64. As shown at block 66, the first adornment layer 14" is fixedly attached to the headwear piece 12 and stocked, as shown at block 68.

The article with this appearance is generally a potential draw to a follower of participant A, which may be a home town sports team. In one scenario, the headwear piece 12 can be adorned with the first adornment layer 14", with participant A involved in a "series", which is a common format for baseball playoffs and the ultimate championship competition. One wishing to sell the headwear 12 might, relying on participant A being a favorite in the event, manufacture a significant quantity of the headwear piece 12 with the first adornment layer 14" tack stitched thereto, as previously described.

At the conclusion of the event, the answer as to whether first adornment layer 14" is appropriate, i.e. whether participant A is victorious, is determined, as indicated at block 69. If the answer is "yes", the headwear piece 12 with the first adornment layer thereon is displayed and offered for sale, as seen at block 70.

In the event that participant A is not the successful participant in the particular event, and the response to the question of whether the first adornment layer 14" is appropriate is "no", the first adornment layer 14" is removed from the headwear piece 12, as shown in block 71. The thread 44 at the various tack stitch locations can be cut to separate the first adornment layer 14" from the headwear piece 12.

Figure 9:
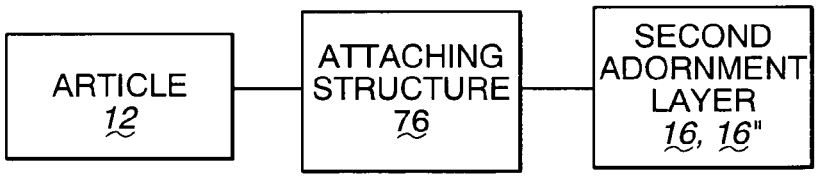
FIG. 9 is a schematic representation of attaching structure through which the second adornment layer is attached to an article.

Thereafter, the second adornment layer 16" can be fixedly attached to the headwear piece 12, as indicated at block 72. The attachment process may involve tack stitching or utilize any other means known to those skilled in this art. As shown in FIG. 9, the second adornment layer 16, 16" can be attached to the article 12 utilizing any attaching structure, as shown generically at 76. For example, the attaching structure may be a combination of an adhesive and stitching. The stitching may be a chain stitching or other type of stitching, i.e. lock stitching, which is more permanent in nature, etc.

Referring again to FIG. 8, as shown at block 78, the headwear piece 12 with the second adornment layer 16" attached is made available to consumers to meet actual or anticipated demand therefor.

Figure 8:
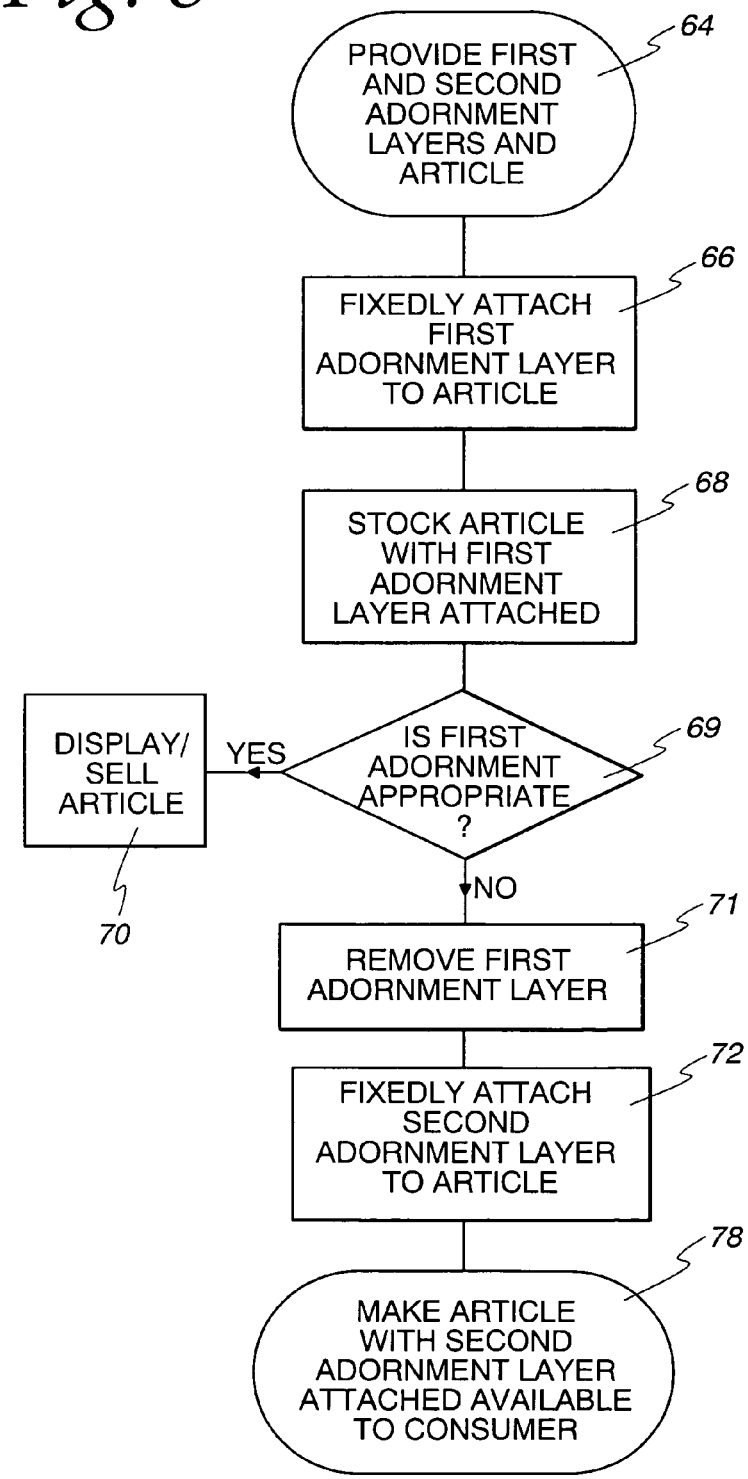
FIG. 8 is a flow diagram showing the steps in the method of providing an article to meet an actual or anticipated demand for the article, according to the present invention.

Given the nature of tack stitching, it is possible for all of the steps shown in FIG. 8 to be carried out at a single site, even at the venue at which the event has taken place involving the participants A and B. For example, the steps can be carried out in a souvenir trailer typically seen outside of stadiums.

Figure 10:
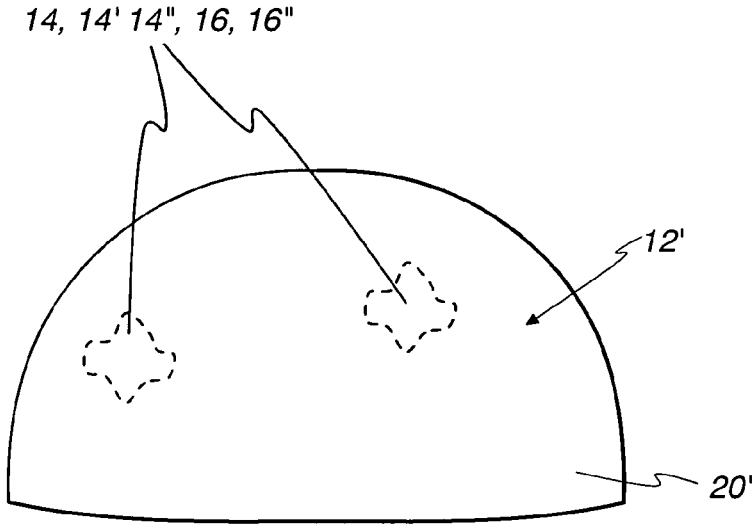
FIG. 10 is an elevation view of a modified form of headwear piece with which the present invention can be practiced.
Figure 11:
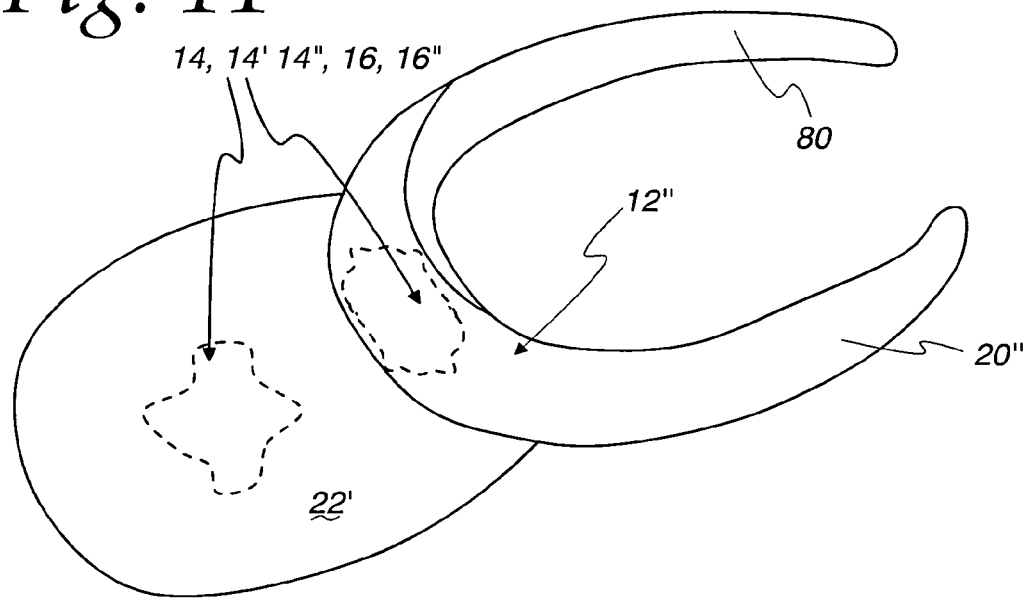
FIG. 11 is a perspective view of a further modified form of headwear piece with which the present invention can be practiced.

The inventive concept can be utilized with other types of headwear, with exemplary alternative forms shown respectively at 12' and 12" in FIGS. 10 and 11.

In FIG. 10, the headwear piece has a crown 20', similar to the crown 20, previously described, but without any corresponding brim/bill 22.

In FIG. 11, the headwear piece 12" is shown in the form of a visor with a crown 20" and brim/bill 22' corresponding to the brim/bill 22. The headwear piece 12" has a crown opening 80 through which a user's head can project with the crown 20" embracing the wearer's head.

In another variation, a supplemental holding means might be utilized in conjunction with the tack stitched thread to maintain adornment layers on a substrate layer. For example, an adhesive might be used which releases to allow separation of an adornment layer without causing damage to an underlying substrate layer. Other supplemental means that allow separation of an adornment layer, without inflicting damage to an underlying substrate layer, are likewise contemplated.

Figure 12:
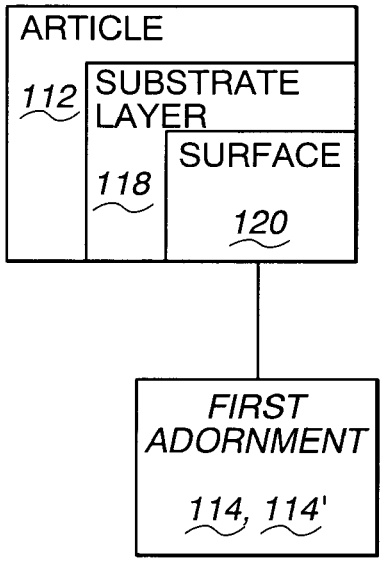
FIG. 12 is a schematic representation of an article having a substrate layer with a surface having a first adornment thereon, according to the invention.
Figure 13:
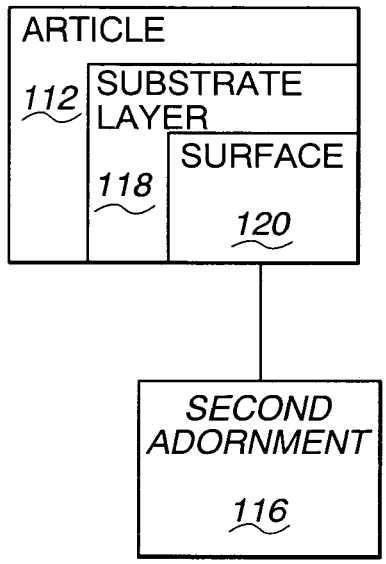
FIG. 13 is a view as in FIG. 12 wherein a second adornment is provided on the article.

In FIGS. 12 and 13, an article 112 is shown with generic types of adornment thereon. In these Figures, the article 112 is intended to represent virtually any type of article, particularly ones relating to apparel, with first and second adornments 114, 114' 116, applied to a substrate layer 118 on the article 112 at an exposed surface 120 thereon.

The first and second adornments 114, 114', 116 may be applied in any manner known to those skilled in the art i.e. weaving, embroidery, application of a patch, etc.

Figure 14:
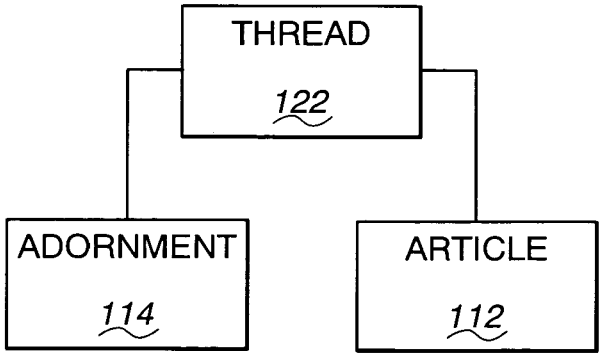
FIG. 14 is a schematic representation of one structure for securing adornment, as shown in FIGS. 12 and 13, to the article.
Figure 15:
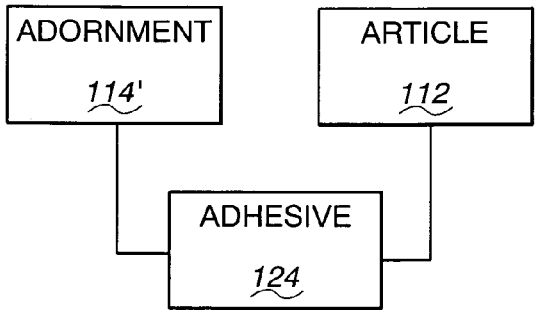
FIG. 15 is a view as in FIG. 14 of a modified structure for securing the adornment to the article.

In FIG. 14, there is a generic showing of the use of thread 122 to form the exemplary first adornment 114. The thread 122 may be woven, sewn, embroidered, stitched, etc., directly on the article 112 to produce the adornment 114. Alternatively, the adornment 114', as shown also in FIG. 15, may be a self-contained element, such as in the form of a patch, that is applied through thread 122 that is woven, sewn, stitched, etc., or by any other suitable means, to fix the element 114' in place. In FIG. 15, the self-contained adornment element 114' is applied to the article 112 through an adhesive 124.

With the first adornment 114, 114' applied to the article 112, the article has a first appearance. With the second adornment 116 applied to the article 112, the article 112 has a second appearance. The difference in appearance may be attributable to a difference in the design, subject matter, or shape of the adornment. Alternatively, the difference may be attributable to the state/quality of the adornment.

With the structure shown in FIGS. 12 and 13, the first adornment 114, 114' is provided on the substrate layer 118. The article 112 having the first appearance is provided to meet an actual or anticipated demand therefor. At a subsequent point in time, an actual or anticipated demand for the article, having an appearance different than the first appearance, is identified. Thereafter, the first adornment 114, 114' is removed, as by severing the thread 122 or peeling a patch to defeat the adhesive 124. The adhesive 124 may be heated to facilitate removal of the patch. In this and all other embodiments herein, it is contemplated that the patch is separated from the substrate layer 118 in a manner whereby the substrate aver 118 remains substantially intact. Thereafter, the second adornment 116 is provided on the substrate layer so that the article 112 has a second appearance to meet an actual or anticipated demand for the article with the second appearance. The article with the second appearance is then made available to meet an actual or anticipated demand therefor.

Figure 16:
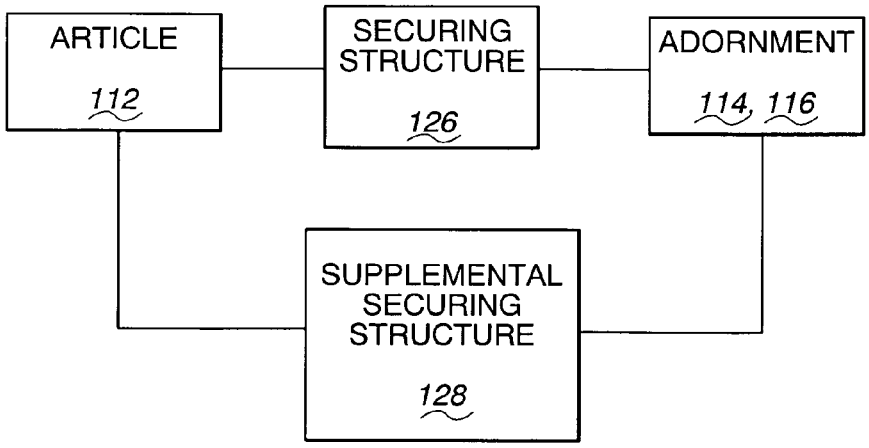
FIG. 16 is a schematic representation of an article having redundant securing structure to maintain adornment in place.

The first and second adornments 114, 116 may be fixedly secured preliminarily using a securing structure 126, of the type described above, as shown in FIG. 16. The securing structure 126 is designed to fixedly maintain the adornment 114', 116 in place and potentially facilitate its removal, if necessary. As shown further in FIG. 16, a supplemental securing structure is provided at 128 and is used to more permanently secure the adornment 114, 116 to the article 112 once a final decision is made with respect to the final appearance of the article 112 that will be offered/sold.

As in prior embodiments, the second adornment 116 may be provided at a location from which the first adornment 114, 114' is removed. The second adornment 116 may fully cover that location and have a greater areal extent. Alternatively, the second adornment 116 may be provided at a location at least partially spaced from the first location at which the first adornment was initially located.

The first and second adornments 114, 114', 116 may differ in appearance or with respect to information that is provided thereon, as previously described in other embodiments. For example, the first adornment 114, 114' may have an identification relating to a first entity that is involved with a second entity in a competition. The second adornment 116 may have information relating to the identity of the second entity. "Information", as used herein, relates to anything that, through design, written words, or otherwise, conveys an association with a particular entity.

As in the previous embodiments, the second adornment 116 may be provided/applied, or further secured, at a site at which the article with the second appearance is sold.

Figure 17:
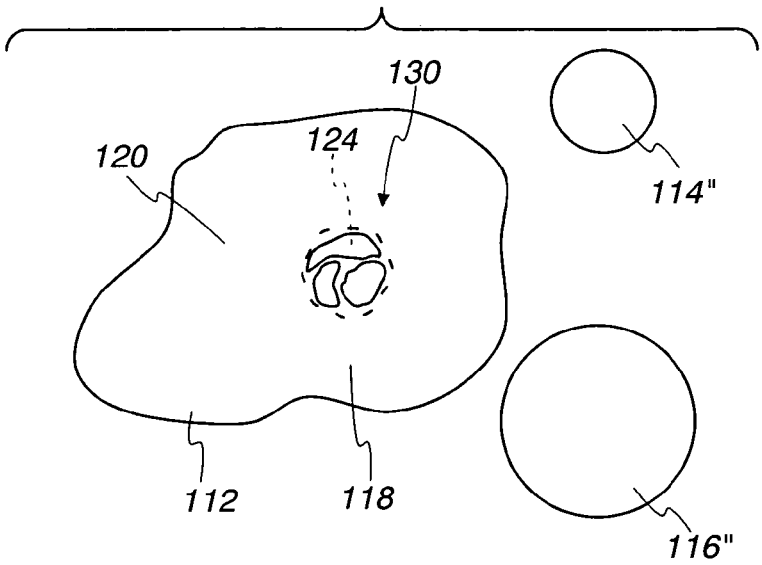
FIG. 17 is a fragmentary, elevation view of a portion of a substrate layer on the article in FIGS. 12 and 13 and with two different adornments, with a first of the adornments having been adhesively applied and removed.

In FIG. 17, a portion of the article 112 is shown with the substrate layer 118 and surface 120. The first adornment 114" is shown in the form of a patch that was originally applied at a first location 130 using an adhesive. By peeling the patch 114", there remains a residual alteration of the surface 120 this case a residual deposit of the adhesive 124 at the location 130. The second adornment 116" can then be reapplied by whatever means and preferably fully covers the area previously occupied by the first adornment 114".

Figure 18:
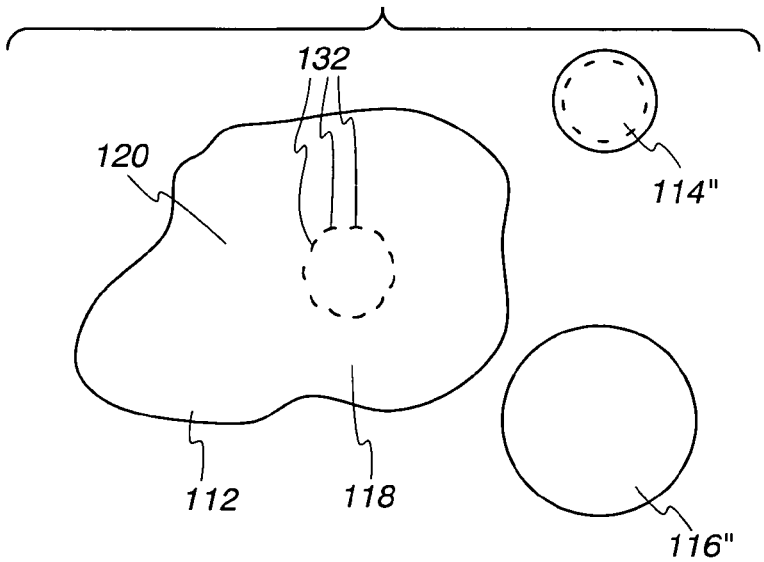
FIG. 18 is a view as in FIG. 17 wherein the first of the adornments was applied using thread and thereafter removed.

In FIG. 18, a similar structure is shown wherein a first adornment in the form of a patch 114" was secured in place through thread 122. The thread is cut to release the patch 114". There is a residual alteration of the surface 120, in this case holes 132 from the thread 122. While the holes 132 may not be significantly visible, the patch 116" may nonetheless fully cover the same to avoid the appearance of any blemish on the surface 120.

The foregoing disclosure of specific embodiments is intended to be illustrative of the broad concepts comprehended by the invention.

The invention claimed is:

1. A method of providing an article with first and second different appearances to meet an actual or anticipated need for the article, the method comprising the steps of:

providing an article having an exposed surface defined by at least one substrate layer;

providing at least a first adornment on the substrate layer so that the article has a first appearance;

stocking the article with the first appearance to meet an actual or anticipated demand for the article with the first appearance based upon a first outcome of an event yet to occur;

identifying an actual or anticipated demand for the article having an appearance different than the first appearance based upon a second outcome of the event once it is determined that the second outcome will occur;

after identifying an actual or anticipated demand for the article having an appearance different than the first appearance, removing the at least first adornment; and providing at least a second adornment on the substrate layer so that the article has a second appearance different than the first appearance and to meet an actual or anticipated demand for the article with the second appearance; and making the article with the second appearance available to meet an actual or anticipated demand for the article with the second appearance.

2. The method of providing an article according to claim 1 wherein the step of providing an article comprises providing an article of clothing.

3. The method of providing an article according to claim 1 wherein the step of providing an article comprises providing a headwear piece.

4. The method of providing an article according to claim 1 wherein the step of providing at least a first adornment on the substrate layer comprises the steps of providing a first patch and securing the first patch fixedly to the substrate layer.

5. The method of providing an article according to claim 4 wherein the step of securing the first patch comprises securing the first patch through sewn thread.

6. The method of providing an article according to claim 4 wherein the step of securing the first patch comprises securing the first patch through an adhesive.

7. The method of providing an article according to claim 6 wherein the step of removing the at least first adornment comprises the step of heating the adhesive.

8. The method of providing an article according to claim 1 wherein the step of providing at least a first adornment on the substrate layer comprises providing the at least first adornment on the substrate layer at a first location and the step of providing at least a second adornment comprises providing the at least second adornment at the first location.

9. The method of providing an article according to claim 8 wherein the step of providing at least a first adornment on the substrate layer comprises providing the at least first adornment on the substrate layer at a first location and the step of providing at least a second adornment comprises providing the at least second adornment at a second location at least partially spaced from the first location.

10. The method of providing an article according to claim 1 wherein the second adornment comprises a patch.

11. The method of providing an article according to claim 1 wherein the step of providing at least a first adornment comprises providing the at least first adornment with an identification of a first sports team and the step of providing at least a second adornment comprises providing the at least second adornment with an identification of a second sports team that competes with the first sports team.

12. The method of providing an article according to claim 1 wherein the step of providing at least first and second adornments comprises providing the at least first and second adornments that at least one of a) are different in shape, b) have different information thereon and c) are different in appearance.

13. The method of providing an article according to claim 1 further comprising the step of displaying the article with the second appearance for sale at a first site and the step of providing at least a second adornment comprises providing the at least second adornment at the first site.

14. The method of providing an article according to claim 1 wherein the step of providing at least a first adornment comprises providing the at least first adornment with an identification relating to a first participant in a competition involving the first participant and a second participant and the step of providing at least a second adornment comprises providing the at least second adornment with an identification relating to the second participant.

15. The method of providing an article according to claim 1 wherein the at least first adornment overlies a first area on the exposed surface on the substrate layer and the step of providing the at least second adornment comprise providing the at least second adornment so as to fully cover the first area.

16. A method of providing an article to meet an actual or anticipated need for the article, the method comprising the steps of:

providing the article having an exposed surface defined by at least one substrate layer;

providing at least a first adornment on the substrate layer so that the article has a first appearance and to meet an actual or anticipated demand for the article with the first appearance;

identifying an actual or anticipated demand for the article having an appearance different than the first appearance;

removing the at least first adornment; and providing at least a second adornment on the substrate layer so that the article has a second appearance different than the first appearance and to meet an actual or anticipated demand for the article with the second appearance; and making the article with the second appearance available to meet an actual or anticipated demand for the article with the second appearance, wherein the step of providing at least a first adornment on the substrate layer comprises the steps of providing a first patch and securing the first patch fixedly to the substrate layer, wherein the step of securing the first patch comprises preliminarily securing the first patch fixedly to the substrate layer and further comprising the step of committing to provide the article with the first appearance and thereafter performing a supplemental securing step to more permanently secure the first patch fixedly to the substrate layer.

17. In combination:

an article of clothing having an exposed surface defined by a substrate layer;

a first adornment that was initially fixedly attached to the substrate layer by one of: a) thread that is one of: i) woven; ii) sewn, or III) stitched; and b) an adhesive to define an article having a first appearance and thereafter removed from the article by separation from the substrate layer in a manner whereby the substrate layer remains substantially intact; and a second adornment fixedly attached to the substrate layer so that the article has a second appearance, wherein the first adornment has information thereon relating to a first participant in a competition involving the first participant and a second participant and the second adornment comprises information thereon relating to the second participant.

18. The combination according to claim 17 wherein the first adornment was fixedly attached to the substrate layer to cover a first area and the second adornment fully covers the first area.

19. The combination according to claim 17 wherein the article comprises a headwear piece with a crown and a brim/bill projecting from the crown.

20. The combination according to claim 17 wherein the article has a residual alteration from at least one of sewn thread and an adhesive used to secure the first adornment to the substrate layer.

21. The combination according to claim 17 wherein the first adornment has an identification of the first participant and the second adornment comprises an identification of the second participant.

* * * * *